United States Patent [19]

Boyd

[11] Patent Number: 4,770,303

[45] Date of Patent: Sep. 13, 1988

[54] DEMOUNTABLE STAND FOR SUPPORTING HANGING PLANTS

[76] Inventor: Edward M. Boyd, 670 Florida Pkwy., Kissimmee, Fla. 32743

[21] Appl. No.: 828,299

[22] Filed: Feb. 11, 1986

Related U.S. Application Data

[63] Continuation of Ser. No. 583,763, Feb. 27, 1984, abandoned.

[51] Int. Cl.[4] ..... A47B 47/00

[52] U.S. Cl. ..... 211/205; 211/133; 211/118

[58] Field of Search ..... 211/205, 71, 118, 133, 211/195, 196, 189; 248/188.7; 47/39

[56] References Cited

U.S. PATENT DOCUMENTS

| | | | |
|---|---|---|---|
| 459,583 | 9/1891 | Johnson | 211/196 X |
| 649,665 | 5/1900 | Keller | 211/88 X |
| 723,114 | 3/1903 | Witt | 211/205 |
| 2,092,691 | 9/1937 | Berghoff | 211/74 |
| 2,187,159 | 1/1940 | Koch | 211/133 X |
| 2,794,554 | 6/1957 | Donner | 211/71 |
| 3,734,301 | 5/1973 | Rastocny | 211/205 |
| 4,291,075 | 9/1981 | Pulio | 211/205 X |
| 4,343,842 | 8/1982 | Chase | 211/205 X |

OTHER PUBLICATIONS

The Washington Post/Potomac/Aug. 24, 1973, The Hecht Co., Plast Tree.

*Primary Examiner*—Reinaldo P. Machado
*Assistant Examiner*—Sarah A. Lechok Eley
*Attorney, Agent, or Firm*—Neal J. Mosely

[57] ABSTRACT

A demountable stand for supporting hanging plants comprises an elongated cylindrical center post having a plurality of sets of circumferentially disposed support arms which extend radially outward therefrom to receive and support hanging plants. The support arms are square bar stock formed into an ornamental configuration. A plurality of sets of circumferentially spaced vertically disposed rectangular connectors having vertically extended square openings are attached circumferentially on the post at various locations along its length to slidably receive one end of the support arms. A bottom set of connectors and leg members provide a base for supporting the assembly in an upright position. Alternatively, straight support arms which extend perpendicular to the longitudinal axis of the post may be employed to support one or more horizontal support members for supporting additional potted plants or to provide a table.

9 Claims, 1 Drawing Sheet

DEMOUNTABLE STAND FOR SUPPORTING HANGING PLANTS

This is a continuation of co-pending application Ser. No. 583,763, filed on Feb. 27, 1984, now abandoned.

BACKGROUND OF THE INVENTION

1. Field of the Invention

This invention generally relates to display stands, and more particularly to a demountable stand for supporting hanging plants.

2. Brief Description of the Prior Art

Display stands for supporting flower pots are known in the art. There are several patents which disclose various stands.

Donner, U.S. Pat. No. 2,794,554 discloses a flower pot stand which may be readily assembled and disassembled for shipping and storage. The stand comprises an upright tubular member formed in sections having flat plate members secured thereto. A plurality of arms extend radially from the corners of the plates and are rotatably mounted thereon. The assembly including the arms may be revolved bodily with respect to the ground or floor. Also, the arms may be rotatably adjusted with respect to each other.

Charchan, U.S. Pat. No. 3,015,024 discloses an illuminated flower pot holder which is anchored in the ground and has a plurality of support arms to support potted plants and which are provided with light bulbs adjacent to the potted plants or flowers. The flower pot stand also includes means for supporting other accessories such as a name plate or lamp shade.

Pipe, U.S. Pat. No. 3,021,960 discloses a demountable clothes rack structure comprising a base which supports an upright square tubular post. The upper end of the post is provided with apertures which receive hanger members. The hanger members are provided with flanges which are inserted into the apertures and lie adjacent the interior of the post. An insert member fits within the post and engages the flanges of the hanger members, clamping them between itself and the interior of the post.

Rastocny, U.S. Pat. No. 3,734,301 discloses a merchandise display device comprising a post, a multi-legged stand, and a plurality of radial display branches held in assembled relation by a plurality of connectors. Each connector has an axial bore and a plurality of circumferentially positioned apertured portions. One of the connectors is rotatably mounted on the post, and another serves as the fixed juncture between the post and the stand.

SUMMARY OF THE INVENTION

It is therefore an object of the present invention to provide a stand for supporting hanging plants which can be readily assembled and disssembled by hand without the use of tools.

Another object of this invention is to provide a stand for supporting hanging plants wherein novel connecting members serve the function of receiving ornamental support arms formed of square rod.

Another object of this invention is to provide a stand for supporting hanging plants which utilizes a minimum amount of material and parts for economical manufacture.

Another object of this invention is to provide a stand for supporting hanging plants which is practical, attractive, and ornamental in appearance.

Another object of this invention is to provide a stand for supporting hanging plants suitable for either indoor or outdoor use.

Other objects of the invention will become apparent from time to time throughout the specification and claims as hereinafter related.

The above noted objects and other objects of the invention are accomplished by a demountable stand for supporting hanging plants comprising; an elongated cylindrical center post having a plurality of sets of circumferentially disposed support arms formed of square bar which extend radially outward therefrom to receive and support hanging plants, a plurality of sets of circumferentially spaced vertically disposed rectangular connectors having vertically extended square openings attached to the circumference of the post at various locations along its length to slidably receive one end of the support arms, and a bottom set of connectors and leg members which provide a base for supporting the assembly in an upright position. Alternatively, straight support arms which extend perpendicular to the longitudinal axis of the post may be employed to support one or more horizontal support members for supporting additional potted plants.

DESCRIPTION OF THE PREFERRED EMBODIMENT

Figure 2:
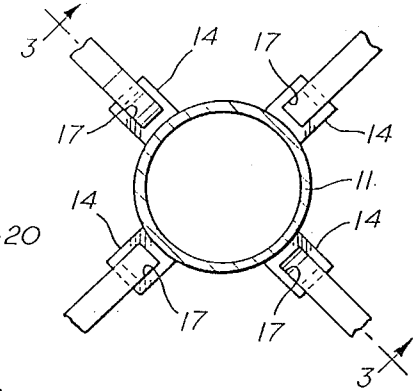
FIG. 2 is a horizontal cross sectional view of the stand taken along lines 2—2 of FIG. 1.
Figure 3:
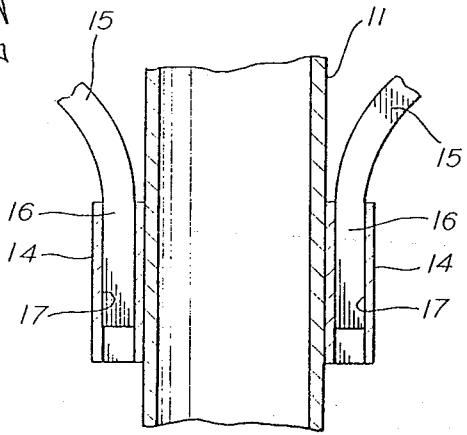
FIG. 3 is a fragmentary vertical cross sectional view of the stand taken along lines 3—3 of FIG. 2.
Figure 1:
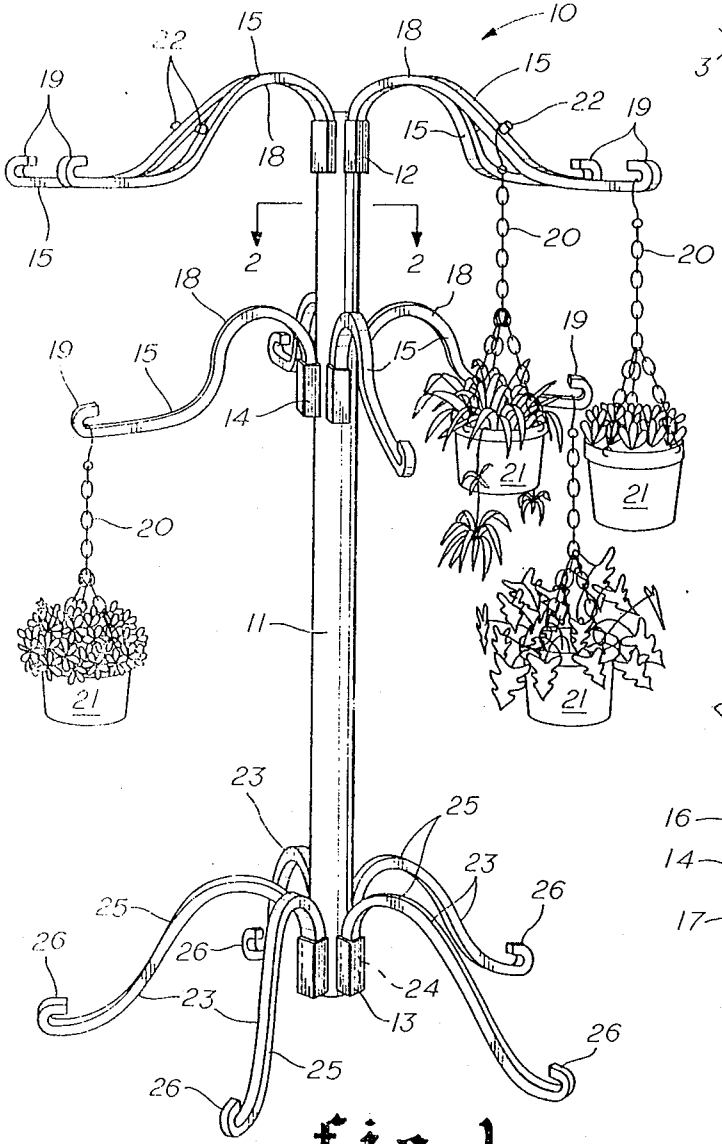
FIG. 1 is a perspective view of one embodiment of the stand in accordance with the present invention.

Referring now to the drawings by numerals of reference, and particularly to FIGS. 1, 2, and 3, there is shown one embodiment of a demountable stand 10 for supporting hanging plants. Stand 10 comprises an elongated cylindrical post 11 having a plurality of sets of circumferentially spaced elongated connectors 12, 13, and 14.

The connectors 12, 13, and 14 are formed of short sections of hollow square tubing secured vertically on the outer periphery of the post 11 by welding, brazing or other suitable means of attachment. One set of connectors 12 are disposed near the top portion of the post 11, another set 13 is disposed near the bottom of the post 11, and other sets 14 may be disposed at various intermediate locations between the top and bottom sets.

The uppermost and intermediate sets of connectors 12 and 14 each receive support arm members 15. The support arm members 15 are formed of square rod bent into an ornamental configuration. One end of each support arm member 15 has a straight portion 16 (FIG. 3) sized to fit snugly in the inner opening 17 of the connector 12 or 14 in parallel axial alignment with the post 11. The remaining ornamentally curved portions 18 of the support arm members 15 extend radially outward from the connectors 12 and 14 and terminate in curved, e.g. hook-shaped, end portions 19 suitable for receiving the chain 20 or hook or handle of a hanging plant 21. Protruding barbs 22 may be provided on the curved portion of the arms 18 to provide means for receiving and supporting additional hanging plants 21 along the length of the supporting arms.

The lowermost set of connectors 13 receive leg members 23. The leg members 23 are formed of square rod bent into an ornamental configuration. One end of each leg member 23 has a straight portion 24 sized to fit snugly within the interior of the connector 13 in parallel axial alignment with the post 11. Straight portions 24 fit downwardly in connectors 13 but tend to twist outward under the weight of the stand which prevents the post 11 from slipping off leg members 23. The remaining curved portion 25 of the leg members 23 extend radially outward from the connectors 12 and terminate in a reverse curved end portion 26 which extends below the bottom of the post 11 to contact the floor or ground and firmly support the post 11 in an upright position. If desired, the upper support arm members 15 can be used for leg members.

Figure 4:
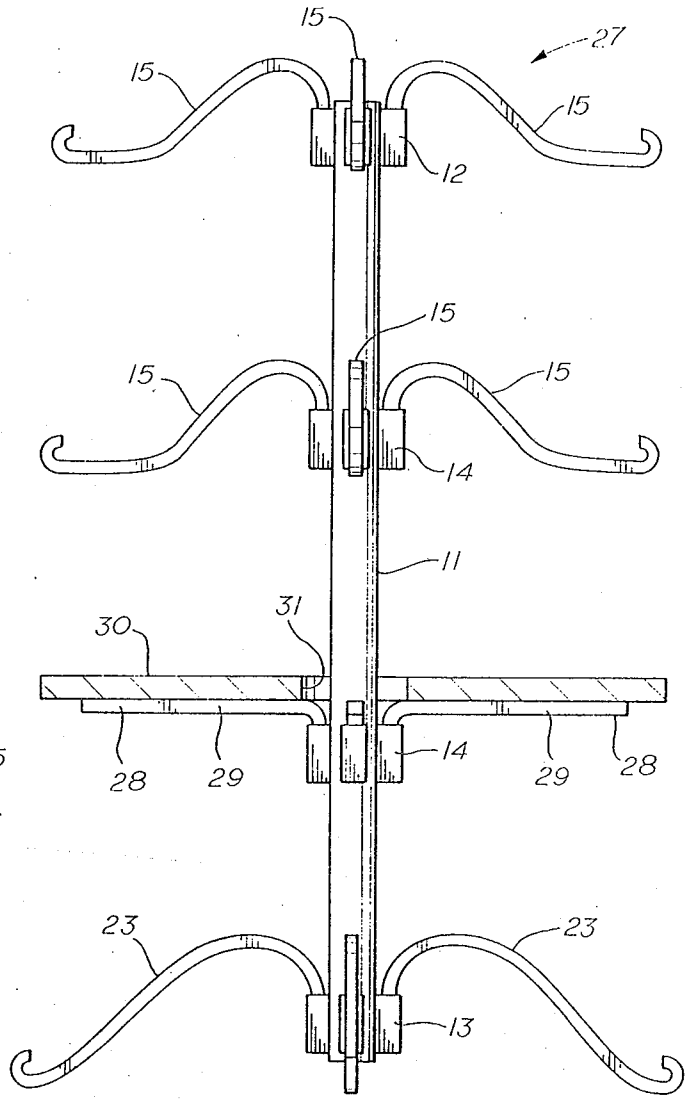
FIG. 4 is a front elevational view of an alternate embodiment of the stand in accordance with the present invention.

FIG. 4 shows and alternate embodiment of a stand for supporting hanging plants 27. In this embodiment, at least one set of ornamentally curved support arms are replaced with a support arms 28 having a straight portion 29 which extends perpendicular to the axis of the post 11, i.e. horizontal. A table top 30 having a central opening 31 of sufficient size to pass over the upper connectors 12 or 14 is supported upon the support arms 28 to provide flat horizontal support surface for receiving additional potted plants.

It should be understood that the stand can have a variety of shapes and sizes of table tops, or a variety of combinations of ornamental support arms and table tops. The stand described above may be readily assembled and disassembled by hand without the use of tools.

While this invention has been described fully and completely with special emphasis upon a preferred embodiment, it should be understood that within the scope of the appended claims the invention may be practiced otherwise than is specifically described herein.

I claim:

1. A kit of parts for assembly into a demountable stand for hanging objects thereon comprising an elongated cylindrical center post adapted to be supported vertically, a plurality of sets of hollow connectors secured on the surface of said post at immovably fixed locations, each set comprising a plurality of said connectors equally spaced circumferentially at one location, and said plurality of sets being in longitudinally spaced relation on said post, each of said connectors having a square opening extending longitudinally in parallel relation to the longitudinal axis of said post, one of said sets of connectors being secured adjacent one end of said post, another of said sets of connectors being secured adjacent the other end of said post, a plurality of leg members each having one end of square cross-section adapted to be slidably and snugly received for easy assembly and disassembly, by hand, without the use of tools, into the upper end of said square openings of said connectors adjacent said one end of said post with their other ends extended radially outward and downward from said post to support said post in an upright position, said leg members each being of square cross-section along the entire length thereof and having a straight end portion adapted to fit downward into the upper opening of said leg-supporting connectors with a sliding and snug fit and having the remaining length thereof curved away from said straight end portion in an ornamental configuration with an end portion rebent in the opposite direction and adapted on assembly to support said post in a vertical position, with the downward force on said leg members causing each to be biased against said post and the outer wall of said support members to support said post against dropping out of said support members, and a plurality of support arms each having one end of square cross-section adapted to be slidably and snugly received for easy assembly and disassembly, by hand, without the use of tools, into the upper end of said square openings of the connectors spaced from said one end of said post with their other ends extended radially outward from said post for supporting objects thereon, said support arms each being of square cross-section along the entire length thereof and having a straight end portion adapted to fit downward into the upper opening of said arm-supporting connectors and having the remaining length thereof curved away from said straight end portion with an end portion rebent in the opposite direction and adapted on assembly to support objects thereon.

2. A kit of parts for assembly into a stand according to claim 1 wherein the radially extended outer end of said support arms include means for receiving and supporting objects thereon.

3. A kit of parts for assembly into a stand according to claim 1 wherein said support arms each have an outwardly projecting barb intermediate its two ends for receiving and supporting an object thereon.

4. A kit of parts for assembly into a stand according to claim 1 further comprising at least one flat planar support member adapted to be supported upon one set of said support arms.

5. A kit of parts for assembly into a stand according to claim 4 in which said flat planar support member is a table of one piece construction having a central opening of sufficient size to be moved over said connectors.

6. A demountable stand for hanging objects thereon comprising an elongated vertically extending cylindrical center post, a plurality of sets of hollow connectors secured on the surface of said post, each set comprising a plurality of said connectors equally spaced circumferentially at one location, and said plurality of sets being in vertically spaced relation on said post, each of said connectors having a square opening extending longitudinally in parallel relation to the longitudinal axis of said post, one of said sets of connectors being secured adjacent the bottom end of said post, another of said sets of connectors being secured adjacent the top end of said post, a plurality of leg members each having one end of square cross-section along the entire length thereof and having a straight end portion removably fitted with a sliding and snug fit, for easy assembly and disassembly, by hand, without the use of tools, downward into the upper end of said square openings of said connectors adjacent said one end of said post and having the remaining length thereof extending first upward then curved radially outward from said straight end portion and downward and then rebent outward from said post to support said post in an upright position, with the downward force on said leg members causing each to be biased against said post and the outer wall of said support members to support said post against dropping out of said support members, and a plurality of support arms each of square cross-section along the entire length thereof and having a straight end portion slidably and snugly received, for easy assembly and disassembly, by hand, without the use of tools, into the upper end of said square openings of the connectors spaced from said one end of said post having the remaining length thereof extending first upward then curved radially outward from said straight end portion and downward and then rebent outward from said post for supporting objects thereon.

7. A demountable stand according to claim 6 wherein said support arms are provided with an outwardly projecting barb intermediate its two ends for receiving and supporting an object thereon.

8. A demountable stand according to claim 6 further comprising at least one flat planar support member secured on one set of said support arms.

9. A demountable stand according to claim 8 in which said flat planar support member is a table of one piece construction having a central opening of sufficient size to be moved over said connectors.

* * * * *